US005621948A

United States Patent [19]

Hartung

[11] Patent Number: 5,621,948

[45] Date of Patent: Apr. 22, 1997

[54] METHOD AND APPARATUS FOR SEVERING A SLIVER DURING COILER CAN REPLACEMENT IN A DRAWING FRAME

[75] Inventor: Reinhard Hartung, Mönchengladbach, Germany

[73] Assignee: Trützschler GmbH & Co. KG, Mönchengladbach, Germany

[21] Appl. No.: 613,173

[22] Filed: Mar. 8, 1996

[30] Foreign Application Priority Data

Mar. 11, 1995 [DE] Germany ..... 195 08 868.9
Dec. 22, 1995 [DE] Germany ..... 195 48 232.8

[51] Int. Cl.[6] ..... B65H 67/04; B65H 54/76; D01H 5/32

[52] U.S. Cl. ..... 19/159 A; 19/150; 19/157

[58] Field of Search ..... 19/150, 157, 159 A, 19/159 R; 242/18.1

[56] References Cited

U.S. PATENT DOCUMENTS

| | | | |
|---|---|---|---|
| 3,381,342 | 5/1968 | Selby et al. | 19/159 A |
| 4,965,912 | 10/1990 | Klüttermann et al. | 19/159 A X |
| 5,414,901 | 5/1995 | Srámek | 19/159 A |
| 5,448,801 | 9/1995 | Wolfgang et al. | 19/159 A |

FOREIGN PATENT DOCUMENTS

| | | |
|---|---|---|
| 0544425 | 6/1993 | European Pat. Off. . |
| 1091010 | 4/1961 | Germany . |
| 3324461 | 10/1984 | Germany . |
| 3807239 | 9/1989 | Germany . |
| 4324948 | 1/1995 | Germany . |
| 666244 | 7/1988 | Switzerland . |
| 967366 | 8/1964 | United Kingdom . |
| 2265161 | 9/1993 | United Kingdom . |
| 93/01335 | 1/1993 | WIPO . |

*Primary Examiner*—John J. Calvert
*Attorney, Agent, or Firm*—Spencer & Frank

[57] ABSTRACT

A method of processing and depositing sliver includes the following steps: drafting the running sliver in a drawing frame; forwarding the sliver by the drawing frame to a coiler head having a sliver outlet; depositing the sliver by the coiler head into a coiler can located underneath the coiler head; replacing a coiler can filled with sliver with an empty coiler can; and rupturing the sliver during the replacing step. To obtain the desired rupture of the sliver, the draft of the running sliver is increased in the drawing frame to such an extent as to provide a location of reduced thickness in the running sliver. Thereupon the filled can is moved away from under the coiler head when the location of reduced thickness in the running sliver is situated in a zone of the sliver outlet of the coiler head.

16 Claims, 3 Drawing Sheets

METHOD AND APPARATUS FOR SEVERING A SLIVER DURING COILER CAN REPLACEMENT IN A DRAWING FRAME

CROSS REFERENCE TO RELATED APPLICATION

This application claims the priority of German Application Nos. 195 08 868.9 filed Mar. 11, 1995 and 195 48 232.8 filed Dec. 22, 1995, which are incorporated herein by reference.

BACKGROUND OF THE INVENTION

This invention relates to a method and an apparatus for severing a sliver during the coiler can replacement in a drawing frame. According to a known method, as sliver deposition takes place, during the coiler can replacement the distance between the sliver coiler, for example, the sliver outlet opening of a rotary coiler head and the uppermost sliver layer in the coiler can is increased to such an extent that the sliver ruptures.

According to a known method described, for example, in German Offenlegungsschrift (application published without examination) 33 24 461 the coiler can filled with sliver has to be rapidly moved away to obtain rupture of the sliver. The rupturing force is derived from the difference between the speed of the coiler can moving out from under the coiler (such as a rotary coiler head) and the velocity of the sliver discharged by the sliver coiler. When the coiler can is full, the sliver delivery speed is switched from "fast" to "slow". It is a disadvantage of this conventional method that the sliver cannot run with the normal (high) operational speed during the coiler can replacement process. It is also a drawback that the heavy, filled coiler can, because of its inertia, cannot be moved away sufficiently rapidly. As a result, the sliver may not rupture with reliability particularly in case of different sliver thicknesses and/or different types of fiber material.

SUMMARY OF THE INVENTION

It is an object of the invention to provide an improved method and apparatus of the above-outlined type from which the discussed disadvantages are eliminated and which ensures a secure rupture of the sliver in a structurally simple manner.

This object and others to become apparent as the specification progresses, are accomplished by the invention, according to which, briefly stated, the method of processing and depositing sliver includes the following steps: drafting the running sliver in a drawing frame; forwarding the sliver by the drawing frame to a coiler head having a sliver outlet; depositing the sliver by the coiler head into a coiler can located underneath the coiler head; replacing a coiler can filled with sliver with an empty coiler can; and rupturing the sliver during the replacing step. To obtain the desired rupture of the sliver, the draft of the running sliver is increased in the drawing frame to such an extent that a location of reduced thickness is provided in the running sliver. Thereupon the filled can is moved away from under the coiler head when the location of reduced thickness in the running sliver is situated in a zone of the sliver outlet of the coiler head.

By virtue of the invention, a reliable severing (rupture) of the sliver is achieved in a structurally simple manner even in case of different thicknesses of the sliver and/or different types of fiber material to be processed.

The process according to the invention is based on the principle to provide an intended location of rupture in the sliver bundle formed of a plurality of slivers. Thus, for this purpose, immediately before coiler can replacement takes place, the principal draft in the drawing zone is significantly increased. The magnitude and duration of the draft change is so selected that the sliver bundle will obtain a location of extremely reduced thickness, yet it still remains coherent. A coiler can replacement process is initiated when the sliver location of such a reduced thickness leaves (or is about to leave) the coiler head. Then the sliver necessarily ruptures at the intended location of breakage during coiler can replacement. The process according to the invention has the additional advantage that during severance the sliver may continue to run with a higher speed and may be introduced into the automatically advanced empty replacement can.

According to additional advantageous features of the invention, the location of reduced thickness is formed in the principal drafting zone; the principal draft is substantially increased immediately before coiler can replacement takes place and the principal draft is increased for a short period of time.

The apparatus according to the invention includes an electronic control and regulating device, such as a microcomputer to which the drive motor for the coiler can advancing device, the driving arrangement for the sliver coiler and the drive for the drawing zone are connected. Also, a sensor detecting the fill level of the coiler can is connected to the control and regulating device and a further, stationary sensor is provided which is associated with the coiler head and which is also connected to the electronic control and regulating device.

DESCRIPTION OF THE PREFERRED EMBODIMENTS

Figure 1A:
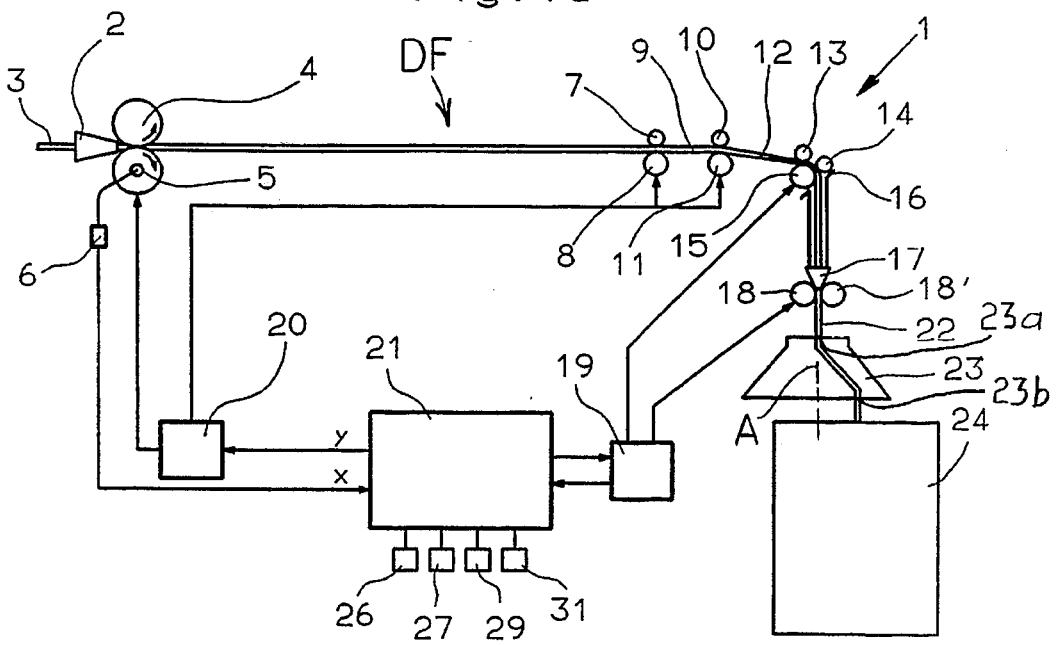
FIG. 1*a* is a schematic side elevational view, including a block diagram, of a regulated drawing frame incorporating the apparatus according to the invention.
Figure 1B:
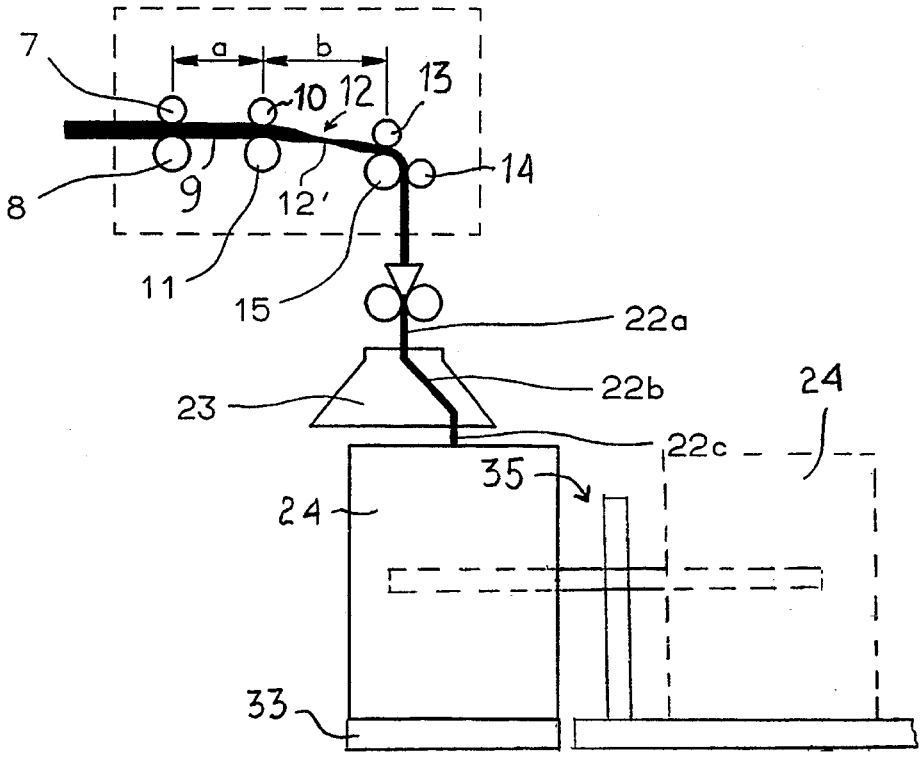
FIG. 1*b* is a schematic side elevational detail, on an enlarged scale, of FIG. 1*a*.

Turning to FIGS. 1*a* and 1*b*, there is illustrated therein a high-output regulated drawing frame generally designated at DF which may be a model HS 900 manufactured by Trützschler GmbH & Co. KG, Mönchengladbach, Germany. A plurality of slivers 3, taken from non-illustrated coiler cans, are, by means of cooperating pull-off rollers 4 and 5, pulled through a sliver guide 2. Thickness variations of the sliver bundle cause radial excursions of the roll 5. The excursions are detected by an inductive path sensor (transducer) 6 which may be a plunger-type solenoid assembly. The drafting unit generally designated at 1 includes an upper inlet roll 7 and a lower inlet roll 8 which are associated with the preliminary drafting zone a. The latter also includes an upper preliminary drawing roll 10 and a lower preliminary drawing roll 11. The principal drawing zone b extends between the upper preliminary drawing roll 10, cooperating with the lower preliminary drawing roll 11 and an upper principal drawing roll 13 cooperating with a lower principal drawing roll 15. A second upper principal drawing roll 14 is associated with the lower principal drawing roll 15. This construction may also be designated as a 4/3 drafting system. That portion of the sliver which is situated in the preliminary drawing zone a is designated at 9 whereas the sliver portion situated in the principal drawing zone b is designated at 12.

The drafted sliver bundle 3, after passing the upper principal drawing roll 14, enters the sliver guide 16 and is, by means of delivery rolls 18, 18' pulled through a sliver trumpet 17 where it is combined into a single sliver 22 which is deposited into a coiler can 24 by means of a coiler head 23 rotating about an axis A and having a sliver inlet **23*a* which is in alignment with the axis A as well as a sliver outlet 23*b* which is eccentric relative to the axis A. The coiler can 24 is rotated about its central longitudinal axis by a rotary platform 33 onto which the coiler can 24 is positioned by a conventional turnstile-type coiler can replacing device 35. The coiler can replacing device 35 thus moves away the full coiler can from under the coiler head 23 and places an empty coiler can to be filled with sliver by the coiler head 23. The principal drawing rolls 13, 14 and 15 as well as the delivery rolls 18, 18' are driven by a principal motor 19 which is controlled by a computer 21 (control and regulating device). The pull-off rolls 4 and 5 are tongue-and-groove rolls for compressing the fiber material in the gap defined between the groove and the tongue. The pull-off roll 5 is resiliently supported and thus is capable of radial excursions in response to thickness fluctuations of the sliver running through the pull-off rolls 4,5. The inductive path sensor 6 transforms radial excursions of the roll 5 into electric signals which are applied to the computer 21. The measuring signals emitted by the transducer 6 are applied to the computer 21 and are converted into commands which control a regulating motor 20 driving the upper pull-off roll 4, the lower pull-off roll 5, the rolls of the preliminary drafting field a, that is, the upper inlet roll 7, the lower inlet roll 8, the upper preliminary drawing roll 10 and the lower preliminary drawing roll 11. Thus, the thickness fluctuations of the running sliver are transformed into radial excursions of the pull-off roll 5, the excursions are transformed into electric signals by the transducer 6 and applied to the computer 21 which, in turn, regulates the motor 20 to change the rpm of the rolls 4, 5, 7, 8, 10 and 11** for changing the draft to thus compensate for the thickness fluctuations of the sliver.

Figure 2:
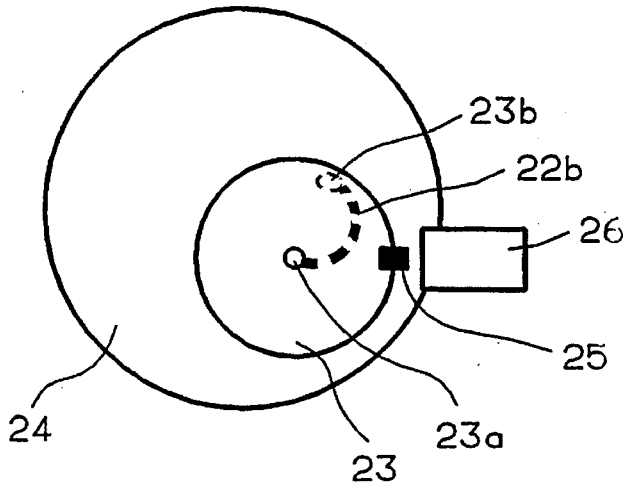
FIG. 2 is a schematic top plan view of a coiler head and the coiler can positioned underneath.

Turning to FIG. 2, a position indicating element 25, such as a metal tab or lug is affixed to the upper surface of the rotary coiler head 23. A proximity sensor 26 cooperating with the position indicating element 25 is stationarily secured to the upper surface of a stationary coiler head holder, so that upon each revolution of the coiler head 23, the position indicator element 25 sweeps by the proximity sensor 26.

During operation, according to the invention a desired location of rupture is worked into the sliver processed by the drawing frame DF. For this purpose, immediately before a coiler can replacement is to take place, the principal draft in the drawing zone b is substantially increased, that is, the rpm of the motor 19 for the roll 15 (entraining the rolls 13 and 14) is increased. The magnitude and duration of the change in draft are so selected that the thickness of the sliver 12 will be substantially reduced to obtain an extremely thin sliver location 12' without, however, rupturing the sliver at that time. The coiler can replacement is initiated when the sliver location 12' is in the region of the sliver outlet opening **23*b* of the coiler head 23. If the location 12' is located at the outer edge of the coiler head 23, the coiler head 23 is stopped. As the coiler can replacement is under way, the sliver 22 automatically breaks at the location 12'**.

Figure 3:
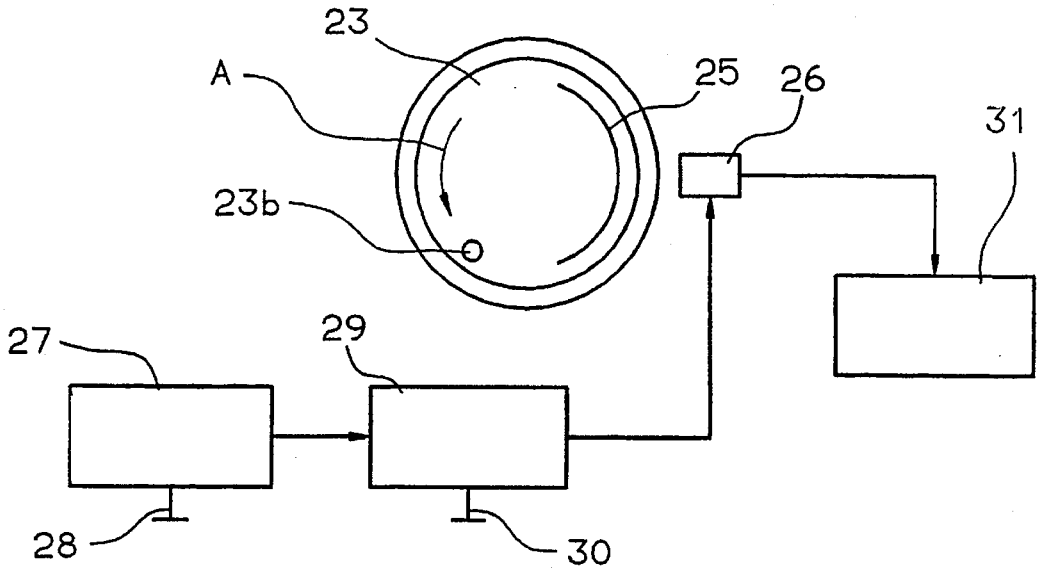
FIG. 3 shows a schematic bottom plan view of the coiler head and a block diagram associated with a position sensor.

Turning to FIG. 3, a measuring member 27 is provided for sensing the fill level of the coiler can 24 and, upon reaching a predetermined deposited sliver length, for example, 3,000 m stored in a desired value transmitter 28, the measuring member 27 applies an electric signal to the drive motor 19 to substantially increase the draft as described above. The measuring member also applies a signal to a drive motor 29 which may be a d.c. motor rotating the coiler head 23 via the coiler can platform 33, to reduce the sliver speed, for example, to the value stored in a memory 30. The speed of the coiler head 23 is reduced as well. At the same time, an electric signal is applied to the proximity sensor 26 which is thus placed in the standby state. When the position indicating element 25 sweeps past the activated proximity sensor 26, the latter applies an electric signal to a drive motor 31 for the coiler can replacing device 35, so that the latter rotates and moves the coiler can 24 out of the filling position. During this procedure, the sliver 22 ruptures at the location 12'.

The measuring elements 26 and 27 and the drive motors 29 and 31 are connected to the control and regulating device 21 as shown in FIG. **1*a***.

Figure 4:
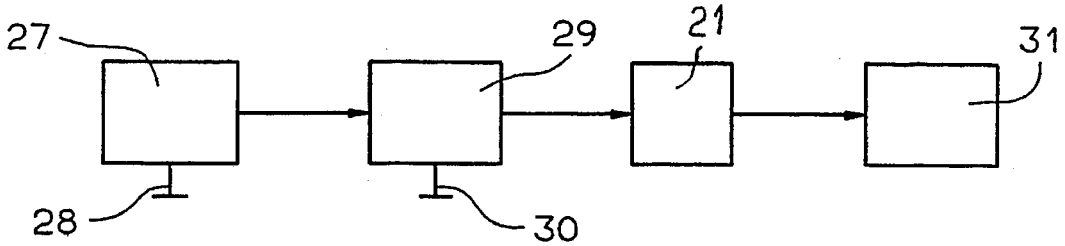
FIG. 4 is a block diagram for the drive of a rotary can replacing device.

In FIG. 4, in contrast to FIG. 3, no measuring device for the position of the coiler head 23 is provided, that is, this circuit is adapted for the case when the velocity difference between the out-moving coiler can 24 to be replaced and that of the after-delivered sliver is sufficiently large to ensure a sliver breakage.

The invention may find application in sliver coilers where the replacement movement is either circular (effected, for example, by the turnstile-type device 35) or linear and further, the invention may be used with coilers operating with stationary, rotating or reciprocating cans.

Figure 5A:
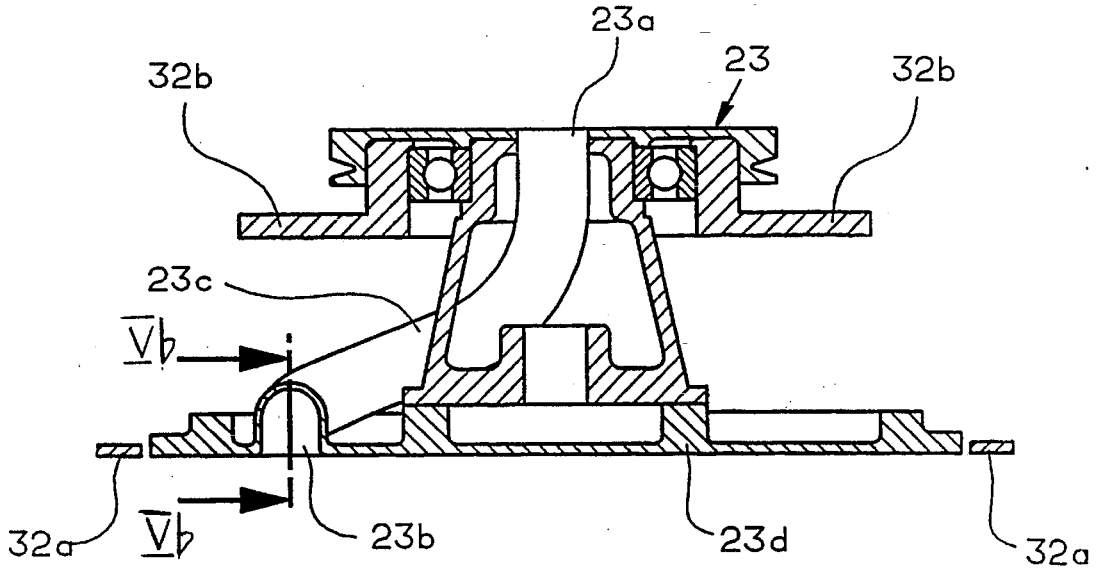
FIG. 5*a* is a sectional elevational view of the coiler head.
Figure 5B:
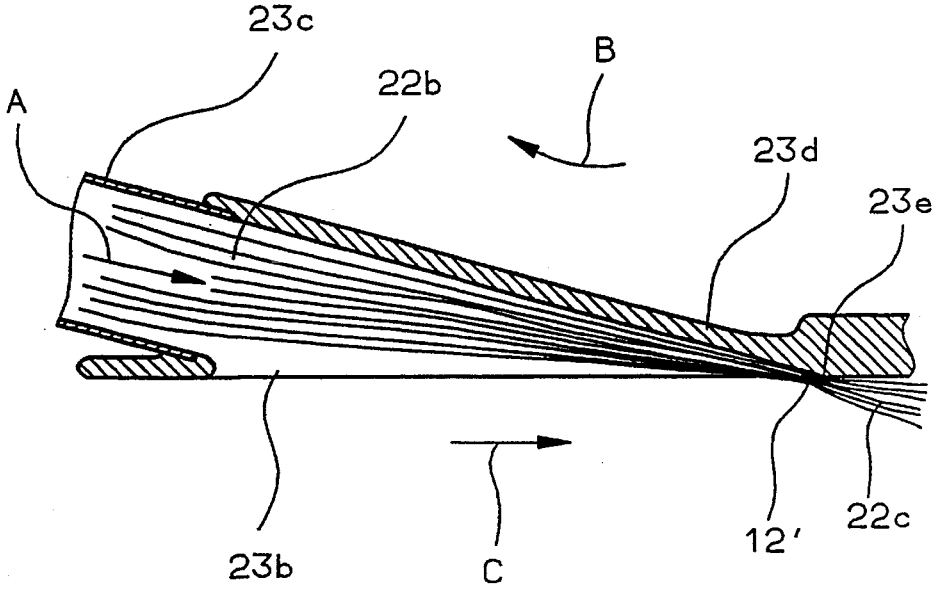
FIG. 5*b* is a sectional view taken along lines Vb—Vb of FIG. 5*a*.

Turning to FIG. **5*a*, the coiler head 23 is accommodated in an opening of a stationary head plate 32. The coiler head 23 has, between the sliver inlet opening 23*a* and the sliver outlet opening 23*b* a sliver guide channel 23*c* which may be constituted by a bent tube. The sliver outlet opening 23*b* which is situated in the underside of the rotary head plate 23*d* has, as shown in FIG. 5*b*, a circumferential edge 23*e*. The sliver 22*b* moves in the sliver channel 23*c* in the direction of the arrow A and, after leaving the sliver outlet opening 23*b* enters the coiler can 24, as shown in FIGS. 1*a* and 1*b*. During sliver breakage, the coiler head 23 rotates either in the direction of the arrow B or is at a standstill. When the location 12' of reduced thickness is situated at the edge 23*e* (oriented away from the rotary direction B), the coiler can 24 is pulled away in the direction of the arrow C by the coiler can replacing device 35, as a result of which the sliver 22*b* ruptures at the location 12' lying on the edge 23*e***.

It will be understood that the above description of the present invention is susceptible to various modifications, changes and adaptations, and the same are intended to be comprehended within the meaning and range of equivalents of the appended claims.

What is claimed is:

1. In a method of processing and depositing sliver, including the steps of drafting running sliver in a drawing frame;

forwarding the sliver by the drawing frame to a coiler head having a sliver outlet;

depositing the sliver by the coiler head into a coiler can located underneath the coiler head;

replacing a coiler can filled with sliver with an empty coiler can; and rupturing the sliver during the replacing step;

the improvement wherein the step of rupturing comprises the following steps:

(a) increasing a draft of the running sliver in the drawing frame to such an extent as to provide a location of reduced thickness in the running sliver; and (b) moving the full can away from under the coiler head when the location of reduced thickness in the running sliver is situated in a zone of the sliver outlet of said coiler head.

2. The method as defined in claim 1, further comprising the step of detecting the fill level of the coiler can while receiving sliver from the coiler head; and initiating step (a) after the fill level has reached a predetermined value.

3. The method as defined in claim 1, wherein step (a) has a momentary duration.

4. The method as defined in claim 1, wherein said drawing frame has a principal drafting zone; said step (a) being performed in said principal drafting zone.

5. The method as defined in claim 1, wherein said outlet opening is bordered by an outer edge; said step (b) is performed when said location of reduced thickness is situated on said outer edge.

6. The method as defined in claim 1, further comprising the step of maintaining the coiler head stationary while performing step (b).

7. The method as defined in claim 1, further comprising the step of reducing, while performing step (b), the speed of the coiler head from a normal operating speed.

8. The method as defined in claim 1, further comprising a sliver inlet provided in said coiler head and a sliver channel coupling said sliver inlet with said sliver outlet; said location of reduced thickness being located in said sliver channel while step (b) is performed.

9. The method as defined in claim 1, wherein said step (b) is performed when said location of reduced thickness has left said sliver outlet.

10. In an apparatus for processing and depositing sliver, including a drawing frame having consecutive pairs of drafting rolls through which the sliver runs;

a first drive means for rotating the drafting rolls of different pairs at different speeds to impart a draft to the running sliver;

a coiler head supported adjacent said drawing frame for receiving sliver discharged by said drawing frame; said coiler head having a sliver outlet;

a second drive means for operating said coiler head; and a coiler can replacing device for moving a first, sliver-filled coiler can away from under the coiler head and moving a second, replacement coiler can underneath the coiler head;

a third drive means for operating said coiler can replacing device;

the improvement comprising (a) a fill level sensor for detecting a fill level in said first coiler can; and (b) a control and regulating device connected to said fill level sensor, said first, second and third drive means for causing said draft to be increased upon receiving from said fill level sensor a signal representing a desired fill level, whereby a location of reduced thickness in the running sliver is provided and for causing operation of said coiler can replacing device to move said first coiler can away from under said coiler head, whereby the sliver is ruptured at said location of reduced thickness.

11. The apparatus as defined in claim 10, wherein said coiler head is supported for rotation about an axis eccentric relative to said sliver outlet; further comprising a position sensor connected to said control and regulating device and being supported adjacent said coiler head for emitting a signal representing a predetermined position of said sliver outlet along an orbiting path thereof; said control and regulating device activating said position sensor in response to receiving said signal from said fill level sensor; and said position sensor applying an initiating signal for actuating said third drive means when said position sensor detects said predetermined position of said sliver outlet of said coiler head.

12. The apparatus as defined in claim 11, further comprising means for defining an edge bounding said sliver outlet; said location of reduced thickness being positioned on said edge upon actuation of said third drive means by said position sensor.

13. The apparatus as defined in claim 11, wherein said position sensor is connected with said fill level sensor and said second drive means.

14. The apparatus as defined in claim 13, wherein said position sensor is connected with said third drive means.

15. The apparatus as defined in claim 11, wherein said position sensor comprises a proximity sensor.

16. The apparatus as defined in claim 15, further comprising a metal element affixed to said coiler head and cooperating with said proximity sensor.

* * * * *